US006974936B2

(12) United States Patent
Yamauchi et al.

(10) Patent No.: US 6,974,936 B2
(45) Date of Patent: Dec. 13, 2005

(54) HIGH FREQUENCY HEATING APPARATUS

(75) Inventors: Masato Yamauchi, Kyoto (JP); Toshiyuki Ishiguro, Nara (JP); Hirofumi Yoshimura, Nara (JP); Fumihiko Migaki, Nara (JP); Hisahiro Nishitani, Yamatotakada (JP)

(73) Assignee: Matsushita Electric Industrial Co., Ltd., Osaka (JP)

( * ) Notice: Subject to any disclaimer, the term of this patent is extended or adjusted under 35 U.S.C. 154(b) by 206 days.

(21) Appl. No.: 10/235,766

(22) Filed: Sep. 5, 2002

(65) Prior Publication Data

US 2003/0047560 A1 Mar. 13, 2003

(30) Foreign Application Priority Data

Sep. 11, 2001 (JP) ..... P.2001-274615
Dec. 14, 2001 (JP) ..... P.2001-381352
May 10, 2002 (JP) ..... P.2002-135154

(51) Int. Cl.[7] ..... H05B 6/68
(52) U.S. Cl. ..... 219/757; 219/710
(58) Field of Search ..... 219/757, 707, 219/710; 126/21 A, 299 R, 299 D

(56) References Cited

U.S. PATENT DOCUMENTS 3,783,219 A * 1/1974 Tateda ..... 219/757
4,143,646 A * 3/1979 Sampsel ..... 219/757
4,418,261 A * 11/1983 Jailor et al. ..... 219/757
4,786,774 A * 11/1988 Kaminaka ..... 219/757
4,886,046 A * 12/1989 Welch ..... 219/757
5,951,907 A * 9/1999 Kang ..... 219/757
5,981,929 A * 11/1999 Maeda et al. ..... 219/757
6,018,158 A * 1/2000 Kang ..... 219/757
6,025,582 A * 2/2000 Kang et al. ..... 219/757
6,211,504 B1 * 4/2001 Lee ..... 219/757
6,239,419 B1 * 5/2001 Kim ..... 219/757
6,291,809 B1 * 9/2001 Ha ..... 219/757
6,329,646 B1 * 12/2001 Fukuda et al. ..... 219/757
6,578,569 B2 * 6/2003 Liese ..... 126/299 R
6,717,122 B2 * 4/2004 Roh ..... 219/757
6,812,444 B2 * 11/2004 Ahn ..... 219/757
2002/0050492 A1 * 5/2002 Kim ..... 219/757
2002/0084266 A1 * 7/2002 Ahn ..... 219/757

FOREIGN PATENT DOCUMENTS

JP 11-166732 6/1999

* cited by examiner

*Primary Examiner*—Teresa J. Walberg
(74) *Attorney, Agent, or Firm*—Pearne & Gordon LLP

(57) ABSTRACT

A high frequency heating apparatus is equipped with an oven hood fan, including a heating chamber for entering/deriving an article to be heated into/from the heating chamber, an electric power supplying apparatus for radiating electromagnetic waves into the heating chamber, a cooling fan for cooling the electric power supplying apparatus, another heat-cooking apparatus operated by gas or electric power, which is installed under an appliance main body, and a ventilation means for sucking hot air from an air intake port, which is generated from the another heat-cooking apparatus, and for exhausting the sucked hot air. In the apparatus, wind which cools a heat generating unit of the electric power supplying apparatus by the cooling fan is joined onto an air intake path of the ventilation fan.

5 Claims, 14 Drawing Sheets

HIGH FREQUENCY HEATING APPARATUS

BACKGROUND OF THE INVENTION

1. Field of the Invention

The present invention is related to a high frequency heating apparatus equipped with a high frequency heating cooking apparatus and a ventilating apparatus of a cooker provided under a main body of the high frequency heating apparatus. The present invention is also related to a high frequency heat-cooking apparatus equipped with an oven hood, which owns a ventilation fan capable of sucking gas generated from another heating/cooking apparatus to exhaust the generated gas. Furthermore, the present invention is related to a high frequency heating apparatus equipped with an oven hood fan, which heats an article to be heated. More specifically, the present invention is directed to a method of cooling a high frequency electric power supplying apparatus capable of protecting a heating member from over heat destruction even when the high frequency electric power supplying apparatus is operated under ambient temperature environment.

2. Description of the Related Art

Conventionally, as this sort of high frequency heating apparatus, for instance, the following high frequency heating system has been proposed. That is, as indicated in FIG. 6, a magnetron 9 is arranged on the right side of a heating chamber, high-frequency electromagnetic waves (microwave power) are conducted by using a wave-guide 10 to an upper portion of the heating chamber 8, and then the high-frequency electromagnetic waves are supplied from this upper portion of the heating chamber 8 by stirring the electromagnetic waves by a rotated stirrer 11.

Also, as this sort of high frequency heat-cooking apparatus equipped with an oven hood, for instance, Japanese Laid-open Patent Application No.Hei-11-166732 discloses such a high frequency heat-cooking apparatus equipped with an oven hood. FIG. 4 schematically indicates the conventional high frequency heat-cooking apparatus described in the above-explained application. In FIG. 10, reference numeral 101 indicates a main body of an appliance, reference numeral 103 shows another heat-cooking apparatus, and reference numeral 105 indicates a heating chamber. Also, reference number 106 represents a high frequency generating apparatus, reference numerals 109*a* and 109*b* indicate air intake ports, reference numeral 110 shows a ventilation fan, reference numeral 111 denotes an exhaust port, and reference numeral 115 is a cooking article.

Furthermore, conventionally, as a microwave oven equipped with an oven hood fan and a heat-cooking apparatus at a lower portion thereof, a cooling apparatus having a strong cooling capability and also capable of producing a large amount of wind must be provided with this microwave oven in order to avoid that an electric power supplying apparatus is destroyed due to an overheat phenomenon caused by, for example, heat generated from the lower-installed heat-cooking apparatus. On the other hand, since the cooling apparatus having such a strong cooling capability produces large noise, such a noisy cooling apparatus is not matched with the recent market needs (namely, silent cooking places are required). Also, since the cooling apparatus having such a strong cooling capability consumes very high electric power, generally speaking, a ratio of high frequency output power to total power consumption of an electric appliance is necessarily reduced.

In the above-described arrangement of the conventional high frequency heating apparatus, while an opening of the high frequency heating apparatus is arranged at the upper portion of the heating chamber, the high frequency electromagnetic waves are stirred by using the stirrer located in the vicinity of this opening. As a result, superior uniformities as to heating operation can be realized in the case that large-sized food products which stick out from a turn table (turn table is not rotated) is heated by the stirred high frequency electromagnetic waves. However, since the long wave-guide is employed, transmission loss of the high frequency electromagnetic waves may occur, so that the heating efficiency is low and also the microwave power is low. Further, since another cooling fan (not shown) used to cool the magnetron is required, there is another problem that the dimension of the machine chamber is increased and the dimension of the heating chamber is decreased. In addition, since the long wave-guide is equipped with the conventional high frequency heating apparatus, the cost thereof is increased.

Moreover, in the above-described conventional high frequency heat-cooking apparatus, there are many cases that the ventilation fan 110 is actuated in order that gas generated while another heat-cooking apparatus 103 installed under the main body 101 of the appliance is used is not filled within a kitchen. Then, when the ventilation fan 110 is actuated, in such an emergency case that the cooking article 115 fires which contains a large amount of oil components and is being heated by the other heat-cooking apparatus 103, the flames are furthermore blown by the ventilation fan 110. There are such problems that the appliance main body 101 is destroyed, and/or the fired appliance main body 101 spreads to other articles.

Also, when food products are heated by the high frequency heat-cooking apparatus equipped with the oven hood, a cooling fan (not shown) for cooling the high frequency generating apparatus 106 is operated. Even when the ventilation fan 110 is not actuated, there is another problem that flames are sucked by air suction of the cooling fan.

Also, in the case that the cooking article 115 which is being heated by the other heat-cooking apparatus 103 will fire, even when the food product is heat-cooked by the high frequency heat-cooking apparatus equipped with the oven hood, a stop button provided on an operation panel of the appliance main body 101 is manipulated so as to stop cooking of the hood products, or the ventilating operation of the ventilation fan 110 must be stopped even if the ventilation fan 110 is actuated. However, while the flames appear, there are other problems that a dangerous situation happens to occur, and therefore, any persons cannot approach the appliance main body 101.

Furthermore, the above-described conventional high frequency heating apparatus owns the following problem, since such an oven having a self-cleaning function is marketed in which high output power of a lower-installed heat-cooking apparatus operated by gas or electric power is gradually required due to market needs, and temperatures within chambers are reached to 400° C. to 500° C. In connection therewith, the thermal adverse influences given to the high frequency heating apparatus equipped with the oven hood fan are also increased. As a fact that the cooling atmospheric temperature is increased, the cooling effect with respect to the electric power supplying apparatus is deteriorated, so that the destruction of this electric power supplying apparatus easily occurs due to such an overheat phenomenon.

While the cooling apparatus having the strong cooling capability is provided in order to satisfy the cooling performance even under sever conditions, when this cooling apparatus is operated, wind-cutting sounds which are produced from propellers of the cooling fans and the cooling wind are not matched with the recent customer's needs (namely, silent cooking places are needed). Also, since this powerful cooling apparatus consumes high electric power, there are other problems. That is, a ratio of high frequency heating power to a total electric power consumption value of an electronic appliance cannot be increased which is limited due to the law regulation, or the circuit breaker capacity of home electronic appliances. Therefore, increasing of the high frequency heating output power required to speed up cooking time is impeded.

SUMMARY OF THE INVENTION

The present invention has been made to solve the above-explained problems of the prior art, and therefore, has an object to provide a high frequency heating apparatus capable of reducing high frequency loss, capable of increasing a heating efficiency, and capable of making a machine chamber compact, and accordingly capable of increasing a dimension of a heating chamber. Another object of the present invention is to provide a high frequency heating apparatus capable of realizing a uniform heating distribution even when a rotation of a turn table is stopped which is provided at a lower portion of the heating chamber.

The present invention has been also made to solve the above-explained problems of the conventional high frequency heat-cooking apparatus equipped with the oven range, and therefore, has an object to provide such a high frequency heat-cooking apparatus equipped with an oven hood, which is manufactured by a simple construction, and owns a higher safety characteristic by avoiding suction of flames and/or blowing of flames even when a cooking article which is being heated by another heat-cooking apparatus happens to fire.

The present invention has been made to solve all of the above-described problems within only one time by employing a simple arrangement, and therefore, has an object to provide such a high frequency heating apparatus capable of realizing high-speed powerful high frequency heat-cooking performance under stable condition, in which even when a cooling atmospheric temperature is increased which is caused by a thermal adverse influence made by a lower-installed heat-cooking apparatus, an electric power supplying apparatus can be protected from destruction due to an overheat phenomenon. As a consequence, this high frequency heat-cooking apparatus can improve a safety characteristic thereof, can satisfy a silent requirement of a cooking place, and can realize the powerful high frequency heat-cooking performance even under high temperature environmental conditions.

To solve the above-described problems of the prior art, a high frequency heating apparatus of the present invention is arranged by that a magnetron is cooled by using a portion of cooling wind produced from a ventilation fan (exhausting means).

To solve the above-described problems, a high frequency heat-cooking apparatus equipped with an oven hood, according to the present invention, is comprised of: an air intake port for sucking therein gas which is generated from another heat-cooking apparatus installed under an appliance main body; an exhaust fan for exhausting the generated gas sucked from the air intake port; an air exhaust port through which the generated gas is exhausted; and a first detecting apparatus and a second detecting apparatus, for detecting the generation of the gas.

As a result, in such a case that a food product is heat-cooked by using the other heat-cooking apparatus installed under the appliance main body, the ventilation fan is driven by the first detecting apparatus so as to exhaust the generated gas in such a way that the gas generated while the other heat-cooking apparatus is used is not filled within a kitchen. Also, in the case that the food product fires, the supply of the electric power to both the heating means and the control means is interrupted by the second detecting apparatus. As a result, it is possible to avoid that the ventilation fan sucks flames, or blows these flames.

To solve the above-described problems of the prior art, a cooling means of a high frequency electric power supplying apparatus according to the present invention is capable of realizing cooling performance equivalent to, or higher such a cooling performance achieved during normal cooling time. When a lower-installed heat-cooking apparatus is operated by using gas or electric power, an atmospheric temperature is rapidly increased due to a large heat amount thereof. On the other hand, a temperature limitation is previously set to such a temperature sensing means which is installed at a place where this temperature sensing means can easily sense a temperature change caused from the lower-installed heat-cooking apparatus, while this temperature limitation can prevent the high frequency electric power supplying apparatus from being thermally destroyed. When the sensed temperature of the temperature sensing means reaches this temperature limitation, an oven hood fan is automatically actuated, and also, an exhaust of cooling wind which passes through the cooling path of the electric power supply apparatus covered with a rigid member is largely reduced by utilizing a strong air-suction capability of the oven hood fan. As a result, the cooling capability as to the electric power supplying apparatus can be largely increased. Also, even under such a thermal condition that the parts can be hardly and thermally guaranteed, such a cooling performance can be realized without employing a powerful cooling apparatus.

As a consequence, while the high frequency heating apparatus of the present invention merely owns such a simple structure capable of satisfying the cooling performance required during normal cooling time, even under such a thermal sever environment when the lower-installed heat-cooking apparatus is operated by using gas or electric power, the cooling performance equivalent to, or higher than the cooling performance under normal cooling time can be realized by utilizing the strong air suction capability of the oven hood fan which can be automatically actuated by sensing the increase of the atmospheric temperature. Even when the cooling temperature environment is changed, the safety high frequency heating apparatus without any component destination due to the overheat phenomenon can be provided by utilizing an automatic oven hood fan operating performance which is fitted to customer's needs.

Different from the conventional structure of the high frequency heating apparatus equipped with the powerful cooling apparatus in order to secure the cooling performance when the ambient environmental temperature is increased, the high frequency heating apparatus equipped with the oven hood, according to the present invention, owns such a simple cooling structure whose cooling capability is suppressed to a minimum cooling capability. As a consequence, noise produced from the cooling fan and power consumption of the cooling apparatus can be largely reduced. At the same time, recent customer's needs can be satisfied, namely a silent cooking place is required, and high frequency output power is increased so as to speed up cooking time.

Since a high frequency heating apparatus of the present invention is arranged in such a manner that a magnetron is cooled by using a portion of cooling wind of a ventilation fan (exhausting means), the magnetron is cooled by a portion of the cooling wind of the ventilation fan, so that a machine chamber of a main body of the high frequency heating apparatus can be made compact, and also, the magnetron cooling fan is no longer required, so that the high frequency heating apparatus can be made in low cost.

In accordance with the present invention, since both the ventilation fan (exhausting means) and the magnetron are arranged over the heating chamber, a wave-guide can be made short and high frequency loss can be reduced, so that an efficiency of the appliance can be increased.

In accordance with the present invention, since fan cases of the ventilation fans are separated to both a fan case for exhausting hot air of a cooker and another fan case for cooling the magnetron. As a result, even when an exhausting direction of the hot air from the cooker is changed along various directions, for instance, a forward direction, an upper direction, and a backward direction, the magnetron can be continuously cooled.

A high frequency heat-cooking apparatus equipped with an oven hood of the present invention, is featured by comprising: a heating chamber for storing thereinto a food product; an appliance main body having the heating chamber; heating member for heating the food product; control means for controlling a supply of electric power to the heating means; an operation unit for operating the control means; an air intake port for sucking therein gas which is generated from another heat-cooking apparatus; an air exhaust port for exhausting the generated gas sucked from the air intake port; and a first detecting apparatus and a second detecting apparatus, for detecting the generation of the gas. As a consequence, in such a case that a food product is heat-cooked by using the other heat-cooking apparatus installed under the appliance main body, the ventilation fan is driven by the first detecting apparatus so as to exhaust the generated gas in such a way that the gas generated while the other heat-cooking apparatus is used is not filled within a kitchen. Also, in the case that the food product fires, the supply of the electric power to both the heating means and the control means is interrupted by the second detecting apparatus. As a result, it is possible to avoid that the ventilation fan sucks flames, or blows these flames. Furthermore, it is possible to avoid that the appliance main body is destroyed, and/or burned.

A high frequency heat-cooking apparatus equipped with an oven hood of the present invention, is featured by comprising: an air intake port for sucking therein gas which is generated from another heat-cooking apparatus installed under the appliance main body; an exhaust fan for exhausting the generated gas sucked from the air intake port; an air exhaust port through which the generated gas is exhausted; and a first detecting apparatus and a second detecting apparatus, for detecting the generation of the gas. As a consequence, in such a case that a food product is heat-cooked by using the other heat-cooking apparatus installed under the appliance main body, the ventilation fan is driven by the first detecting apparatus so as to exhaust the generated gas in such a way that the gas generated while the other heat-cooking apparatus is used is not filled within a kitchen. Also, in the case that the food product fires, the supply of the electric power to both the heating means and the control means is interrupted by the second detecting apparatus. As a result, it is possible to avoid that the ventilation fan sucks flames, or blows these flames. Furthermore, it is possible to avoid that the appliance main body is destroyed, and/or burned.

According to another aspect of the present invention, both the first detecting apparatus and the second detecting apparatus of the high frequency heat-cooking apparatus equipped with the oven hood are arranged in the vicinity of a bottom portion of the appliance main body. As a result, since the generation of the gas can be easily detected, the air ventilation operation is properly carried out in such a way that the gas generated while another heat-cooking apparatus is used is not filled within the kitchen. Also, even when the food product may fire, the supply of the electric power to the heating means and the control means can be quickly interrupted by the second detecting apparatus, and also, it is possible to avoid that the ventilation fan sucks flames, or blows these flames.

According to yet another aspect of the present invention, the second detecting apparatus of the high frequency heat-cooking apparatus equipped with the oven hood is arranged in the vicinity of the air intake port, as compared with the first detecting apparatus. In the case that the ventilation fan is driven, as well as even when the ventilation fan is stopped, this second detecting apparatus is approached to the generated gas. As a result, the second detecting apparatus can easily detect the fired food product, and can quickly stop that the ventilation fan sucks flames, or blows the flames.

According to still yet another aspect of the present invention, a detection sensitivity of the second detecting apparatus of the high frequency heat-cooking apparatus equipped with the oven hood is set to be lower than a detection sensitivity of the second detecting apparatus. As a consequence, when the food product, and/or the generated gas do not fire, the ventilation fan may constitute the normal automatic ventilation apparatus. The second detecting apparatus can avoid such an erroneous operation that the high frequency heat-cook apparatus equipped with the oven hood is carelessly stopped.

A high frequency heating apparatus equipped with an oven hood fan of the present invention, is featured by such a high frequency heating apparatus equipped with an oven hood fan, comprising: a heating chamber for entering/deriving an article to be heated into/from the heating chamber; an electric power supplying apparatus for radiating electromagnetic waves into the heating chamber; cooling means for cooling the electric power supplying apparatus; another heat-cooking apparatus provided with heating means operated by gas or electric power, which is installed under an appliance main body; and ventilating means for sucking hot air from an air intake port, which is generated from the another heat-cooking apparatus, and for exhausting the sucked hot air; wherein: wind which cools a heat generating unit of the electric power supplying apparatus by the cooling means is joined onto an air intake path of the ventilating means. As a result, when the cooling apparatus cannot achieve the sufficiently high cooling effect due to cooking heat generated from the lower-installed heat-cooking apparatus, the cooling capability of the cooling apparatus can be largely improved by the strong air-intake effects of the oven hood fan. Therefore, destruction of the electric power supplying apparatus due to the overheat phenomenon can be prevented.

A high frequency heating apparatus equipped with an oven hood fan of the present invention, is featured by that the high frequency heating apparatus equipped with the oven hood fan is provided with a function capable of sensing heat generated from the another heat-cooking apparatus to thereby automatically actuate the ventilating means. As a consequence, since the ventilating means is automatically operated, the destruction of the electric power supplying apparatus due to the overheat phenomenon can be avoided.

In a high frequency heating apparatus equipped with an oven hood fan of the present invention, since the cooling wind blown out from the cooling fan is covered by a rigid member, such a cooling wind which is originally blown out in a radial direction can be supplied along the heating member of the electric power supplying apparatus, so that the cooling wind can be effectively collected to the heating member. Furthermore, the atmospheric temperature is increased by operating the lower-installed heat-cooking apparatus, and when the oven hood fan is automatically operated, since the cooling wind path is covered with the rigid member, the exhaust an resistance of the cooling wind which flows along the heating member can be largely reduced by the strong air intake capability of the oven hood fan. Also, since the amount of the cooling wind is largely increased, the large cooling capability can be improved.

Figure 1:
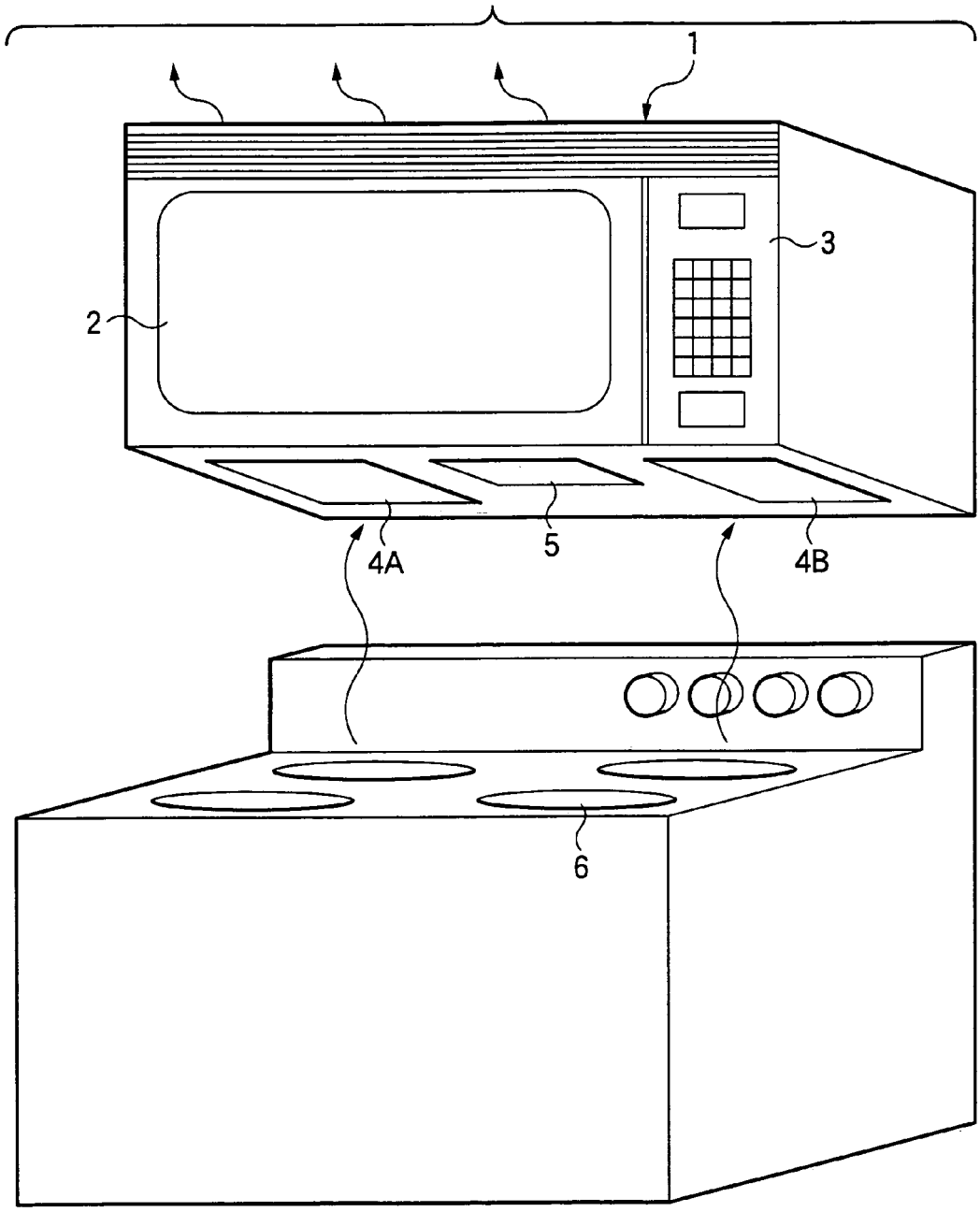
FIG. 1 is a perspective view for indicating a setting condition of a high frequency heating apparatus according to an embodiment 1 of the present invention.

In the drawings, reference numeral 7 refers to a ventilation fan (ventilating means); 9 to a magnetron; 18A and 18B to fan cases; 20 to fan case M; 101 to an appliance main body; 102 to another heat-cooking apparatus; 106 to a high frequency generating apparatus; 109*a* and 109*b* to air intake ports; 110 to a ventilation fan; 111 to am air exhaust port; 115 to a cooking article; 117 to a first detecting apparatus; 118 to a second detecting apparatus; 119 to a control means; 120 to an electric circuit; 201 to a heat chamber; 202 to an oven hood fan (ventilating means); 204 to an air intake port; 205 to a hot vapor derived from lower-installed heat-cooking apparatus (air intake path of ventilating means); 207 to a lower-installed heat-cooking apparatus (another heat-cooking apparatus); 209 to a temperature sensing means; 210 to a cooling means; 211 to a rigid member; 212 to an air-intake cooling wind path; 213 to an air-exhaust cooling wind path; and 215 to an electric power supplying apparatus.

DETAILED DESCRIPTION OF THE PREFERRED EMBODIMENTS

Referring now to drawings, an embodiment of the present invention will be described.

(Embodiment 1)

FIG. 1 is a perspective view of showing a high frequency heating apparatus according to an embodiment 1 of the present invention.

In FIG. 1, a main body 1 of this high frequency heating apparatus is installed above a cooker 6, and contains a ventilation fan which sucks hot air (indicated by arrow) produced from the cooker 6 from two sets of air intake ports 4A and 4B, and then, exhausts the sucked hot air to either an upper portion thereof or an external area. Reference numeral 2 shows a door through which food products are entered/derived. Reference numeral 3 indicates an operation panel for controls a heating operation. Reference numeral 5 shows a lamp window for illuminating the cooker 6.

Figure 2:
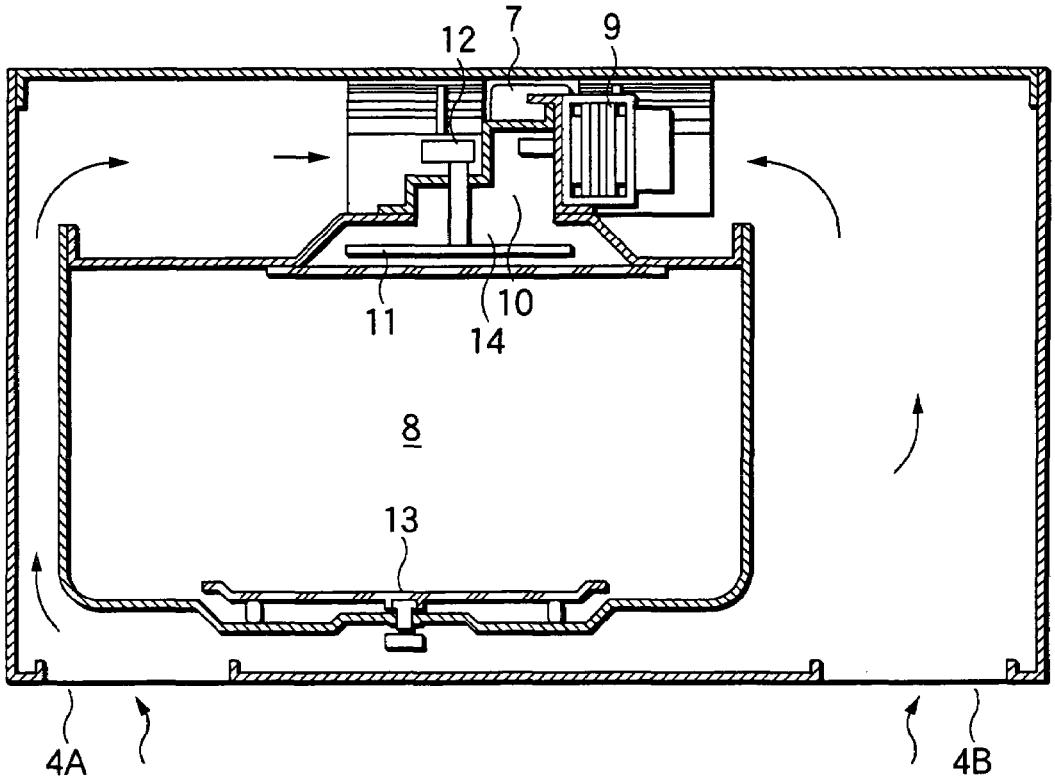
FIG. 2 is a sectional view for showing the high frequency heating apparatus according to the embodiment 1 of the present invention.

FIG. 2 is a sectional view of a center portion of the high frequency heating apparatus shown in FIG. 1. As indicated by arrows, hot air of the cooker 6 is entered from the air intake ports 4A and 4B, is penetrated through the ventilation fan 7, and then is exhausted to the upper portion of the main body 1. On the other hand, a heating chamber 8 for heating a food product (not shown) is arranged inside the main body 1, and a magnetron 9 which oscillates high frequency electromagnetic waves is provided over the heating chamber 8. The magnetron 9 is coupled to the heating chamber 8 by using a short wave-guide 10. While the ventilation fan 7 is located at a rear portion of the magnetron 9, this magnetron 9 is cooled by using a portion of cooling wind of the ventilation fan 7. A stirrer 11 which may stir high frequency electromagnetic waves is provided at an outlet port of the wave-guide to the heating chamber 8. This stirrer 1 is rotated by a stirrer motor 12, so that uniform heating operation may be realized in conjunction with rotations of a turn table 13. Furthermore, in such a case that a food product having a larger size than a size of the turn table 13 is heated, the rotation of this turn table 13 is stopped and this food product may be uniformly heated by rotating the stirrer 11. To this end, the following arranging system may be advantageously employed. That is, while an opening 14 of the wave-guide 10 to the heating chamber 8 is arranged over the heating chamber 8, the stirrer 11 is arranged in the vicinity of this opening 14.

Figure 3:
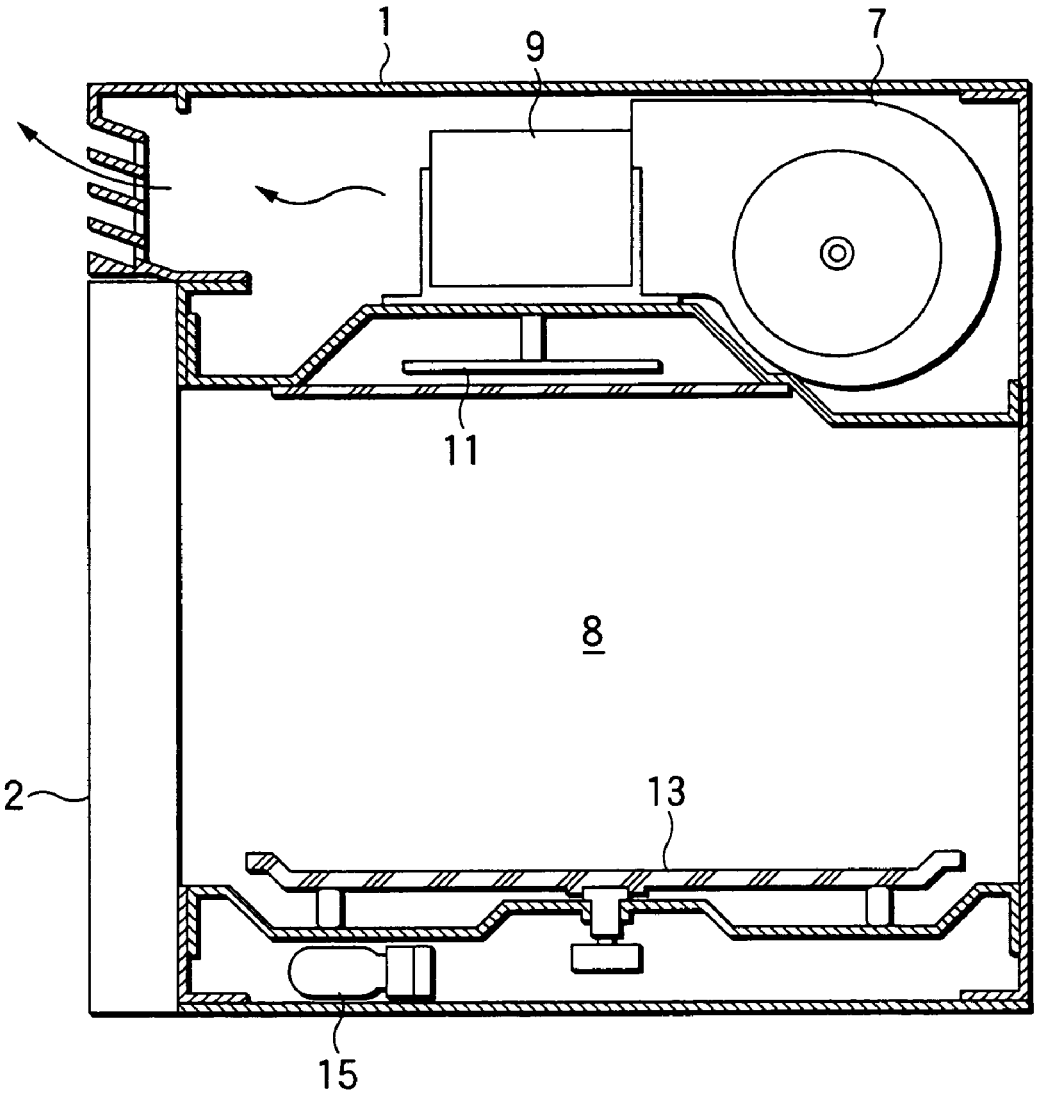
FIG. 3 is a sectional view for showing the high frequency heating apparatus according to the embodiment 1 of the present invention.

FIG. 3 is a sectional view of the construction shown in FIG. 2. In FIG. 3, as indicated by arrows, hot air ventilated from the ventilation fan 7 is exhausted to the upper portion of the main body 1. However, there is another possibility that hot air ventilated from the ventilation fan 7 is exhausted from the upper portion, or the rear portion of the main body 1 to the external area, depending upon requests of customers. Reference numeral 2 shows the door. Reference numeral 8 indicates the heating chamber. Reference number 9 represents the magnetron. Reference numeral 11 denotes the stirrer. Reference numeral 13 shows the turn table. Also, reference numeral 14 shows the opening for a lamp 15 used to illuminate the cooker as explained in FIG. 1.

Figure 4:
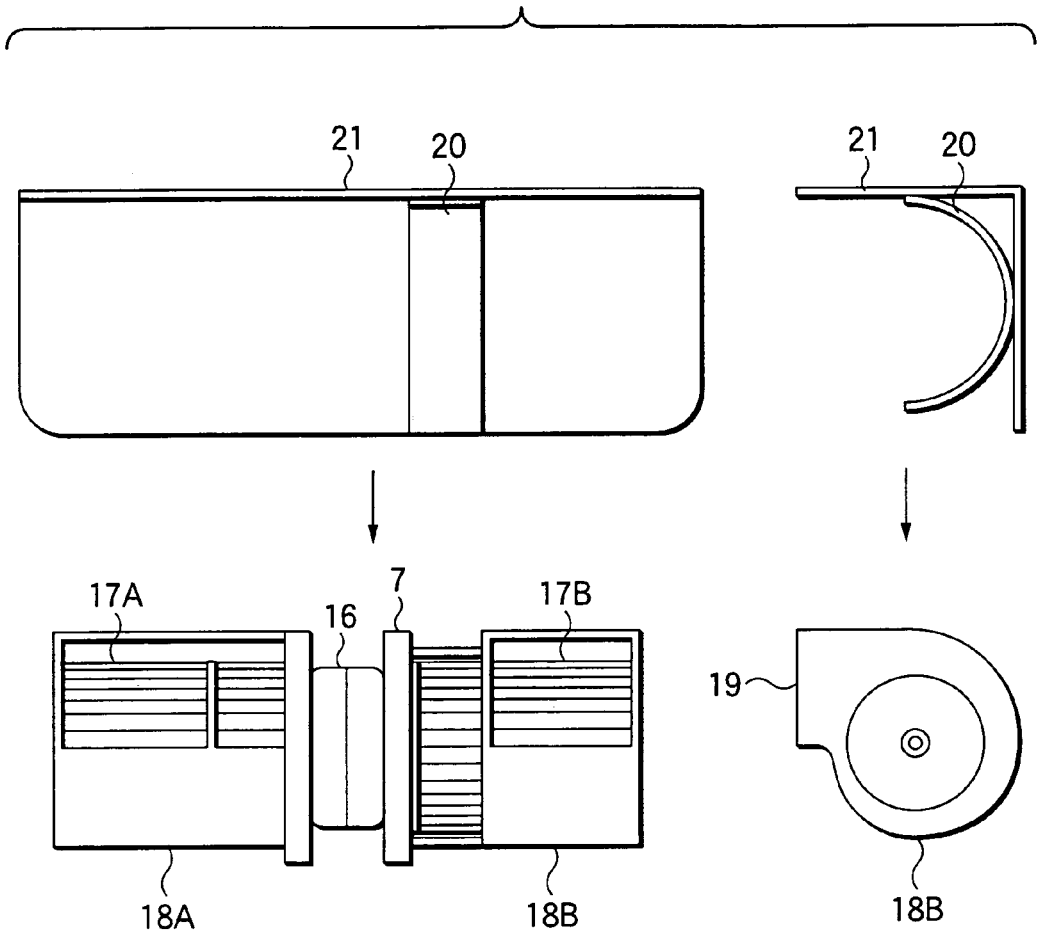
FIG. 4 is a front view and a side view for indicating forward-blowing ventilation fans of the high frequency heating apparatus according to the embodiment 1 of the present invention.

FIG. 4 is a front view and a side view, which show constructions of the ventilation fan 7. In FIG. 4, fans 17A and 17B are provided on both sides of a motor 16 in the ventilation fan 7, and fan cases 18A and 18B are mounted on these fans 17A and 17B, respectively, so that wind is blown from outlet ports 19 of these fan cases 18A and 18B. As a result, the right-sided fan case 18B may eliminate a magnetron cooling portion. A fan case M20 of the magnetron cooling portion is provided on a ventilation fan mounting plate 21. Since both the ventilation fan 7 and the ventilation fan mounting plate 21 are assembled, the cooling operation to the magnetron 9 can be separated from the exhausting operation to the external area from the main body 1.

Figure 5:
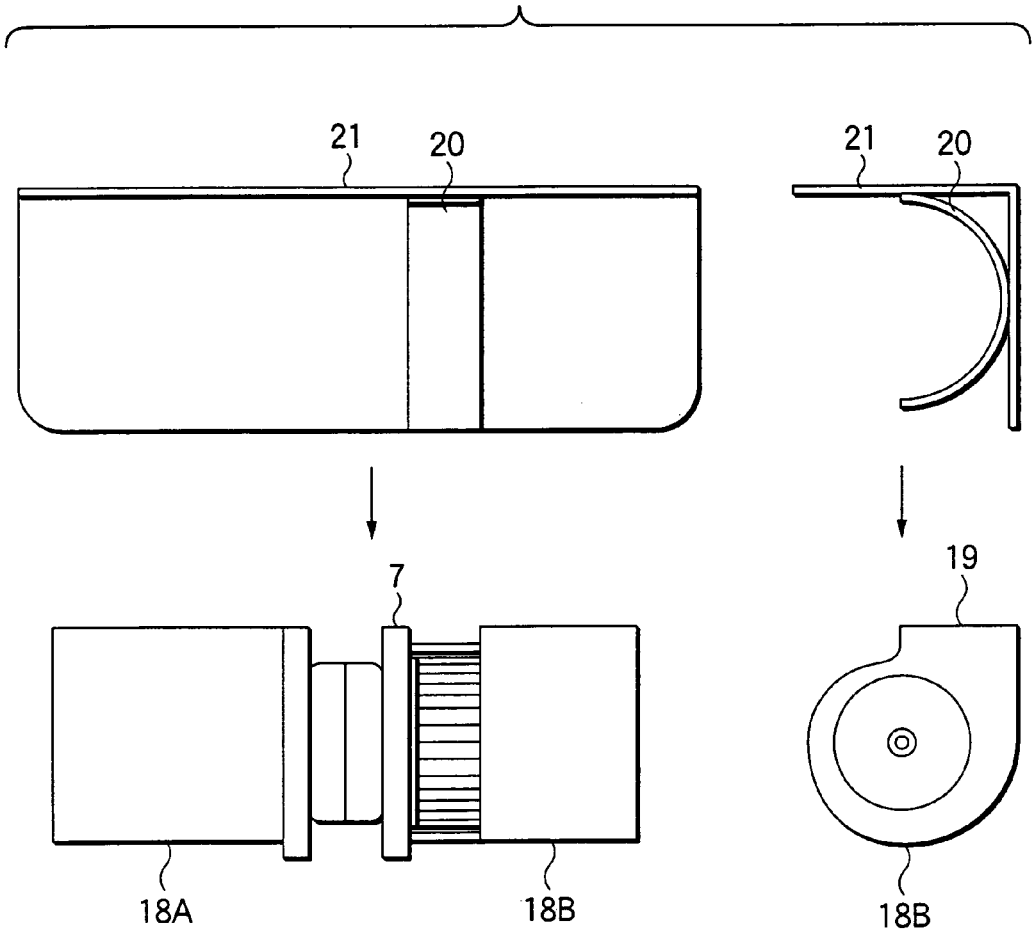
FIG. 5 is a front view and a side view for indicating upward-blowing ventilation fans of the high frequency heating apparatus according to the embodiment 1 of the present invention.
Figure 6:
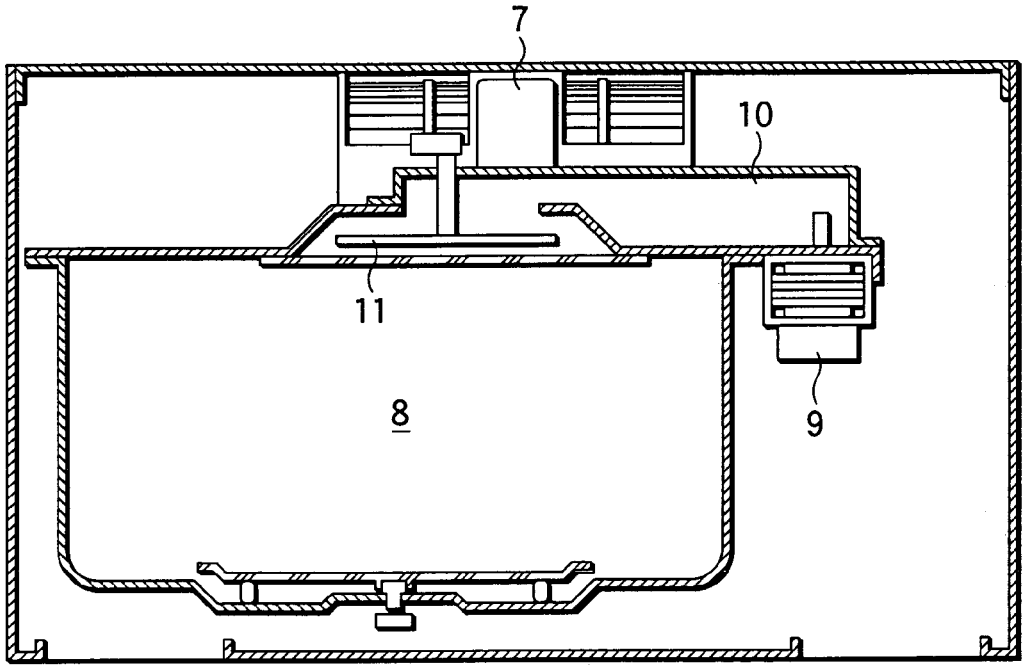
FIG. 6 is a sectional view for representing the conventional high frequency heating apparatus.

FIG. 5 is a front view and a side view in the case that hot air from the ventilation fan 7 is exhausted to an upper portion of the main body 1. In this case, the outlet ports 19 of the fan cases 18A and 18B are assembled with the ventilation fan mounting plate 21 in such a manner that these outlet ports 19 are directed to an upper portion. As a result, the hot air may be exhausted to the upper portion, whereas the cooling wind of the magnetron 9 may be exhausted to the magnetron side, namely, the forward direction.

Also, in the case that the hot air of the ventilation fan 7 is exhausted to the backward direction of the main body 1, the outlets of the fan cases 18A and 18B are directed to the backward direction, and are assembled with the ventilation fan mounting plate 21, so that the cooling wind of the magnetron 9 may be directed to the forward direction.

(Embodiment 2)

Figure 7:
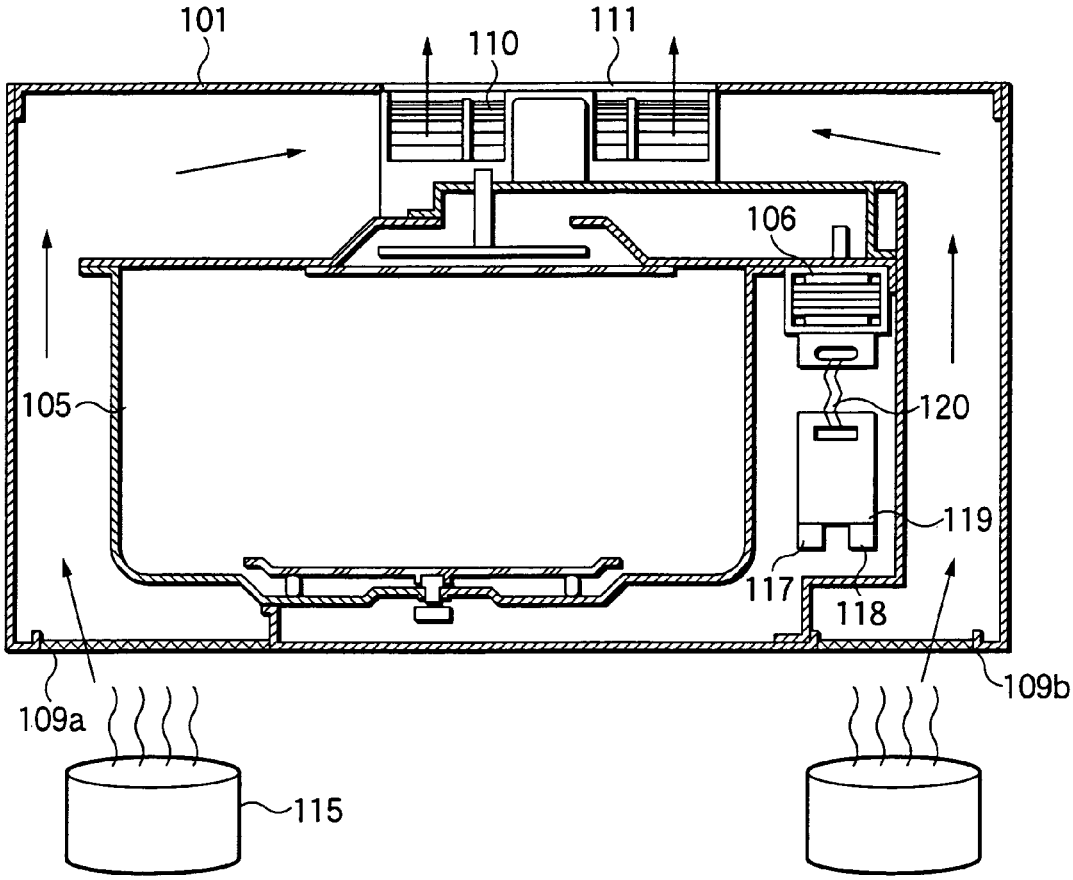
FIG. 7 is a sectional view for indicating a major portion of a high frequency heat-cooking apparatus equipped with an oven hood, according to an embodiment 2 of the present invention.

FIG. 7 is a sectional view for showing a major portion of a high frequency heat-cooking apparatus equipped with an oven hood, according to a second embodiment of the present invention.

In FIG. 7, reference numeral 117 shows a first detecting apparatus installed within a main body 101 of an appliance. This first detecting apparatus 117 is coupled to air intake ports 109*a*, 109*b*, a ventilation fan 110, and an air exhaust port 111 in an organic manner, which constitute an automatic ventilation apparatus. Reference numeral 118 similarly shows a second detecting apparatus. This second detecting apparatus 118 is coupled to a high frequency generating apparatus 106, a control means 119, and an electric circuit 120 employed in the appliance main body 101 in an organic manner, which constitute an automatic electric power supply stopping apparatus.

Subsequently, a description will now be made of operations and effects as to the high frequency heat-cooking apparatus equipped with the oven hood with employment of the above-explained construction.

First, combustion gas and generated gas are detected by the first detecting apparatus 117 to actuate the ventilation fan 110. The combustion gas is generated while another heat-cooking apparatus 103 installed under the appliance main body 101 is used, whereas the generated gas such as oil components, smoke, and vapor is generated from the cooking article 115. The gas generated from the cooking article 115 is sucked from the air intake ports 109*a* and 109*b* into the appliance main body 101, and then, this generated gas passes through the ventilation fan 110. Thereafter, the generated gas is exhausted from the air exhaust port 111 via an air exhaust duct to an outdoor area, so that this generated gas is not filled within a kitchen. Next, while the other heat-cooking apparatus 103 installed under the appliance main body 101 is used, in such a case that the cooking article 15 and the generated gas may fire so that flames and high-temperature smoke may appear, these flames and high-temperature smoke are detected by the second detecting apparatus 118 so as to interrupt the supplies of electric power to the high frequency generating apparatus 106, the control means 119, and the electric circuit 120.

As previously explained, in accordance with this second embodiment, since the high frequency heat-cooking apparatus equipped with the oven hood is arranged by employing both the first detecting apparatus and the second detecting apparatus, which may detect the generations of gas, the gas generated while the other heat-cooking apparatus 3 installed under the appliance main body 1 is used may be exhausted to the outdoor area. Also, in the case that the generated gas fires and/or the flames appear, the second detecting apparatus 18 may detect these gas and flames to interrupt the supplies of electric power to the high frequency generating apparatus 6, the control means 19, and the electric circuit 20. As a result, the comfortable high frequency heat-cooking apparatus equipped with the oven hood and having the higher safety performance can be provided.

(Embodiment 3)

Figure 8:
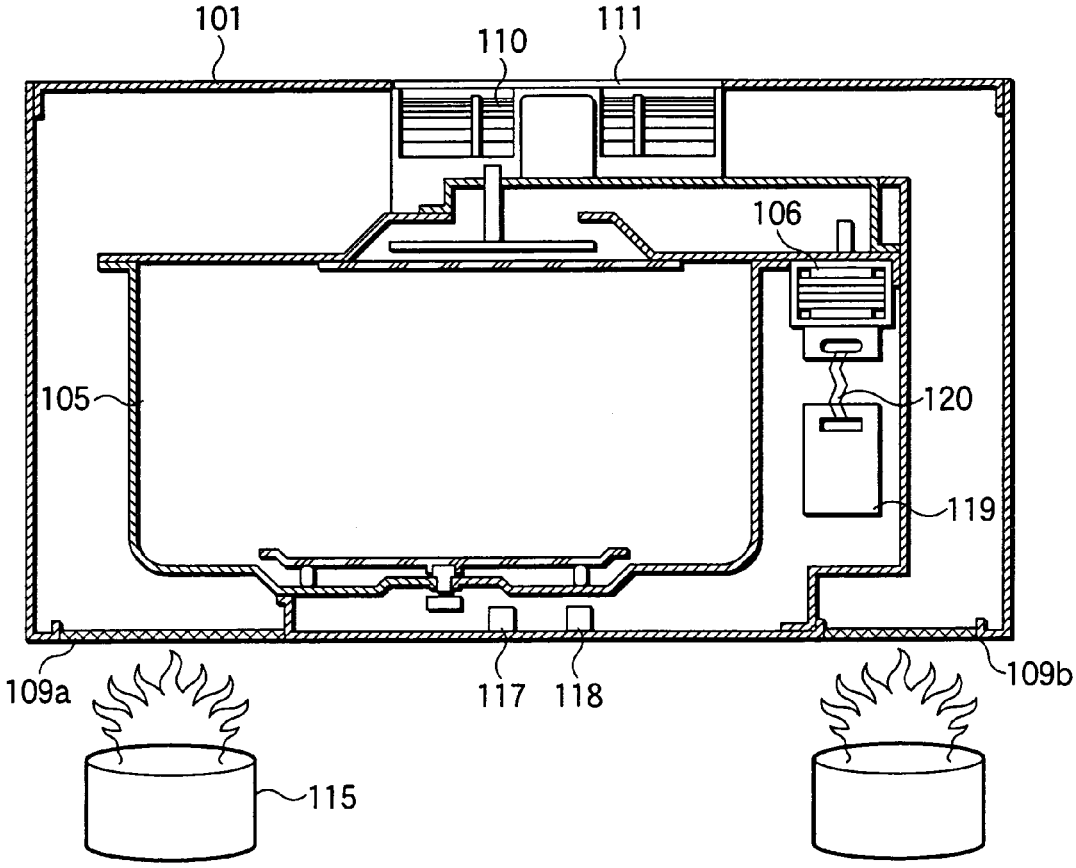
FIG. 8 is a sectional view for indicating a major portion of a high frequency heat-cooking apparatus equipped with an oven hood, according to embodiments 3 and 5 of the present invention.

FIG. 8 is a sectional view for representing a major portion of a high frequency heat-cooking apparatus equipped with an oven hood, according to a third embodiment of the present invention. In FIG. 8, both a first detecting apparatus 117 and a second detecting apparatus 118 are arranged in the vicinity of a bottom portion of a main body 101 of an appliance. An different arrangement of this third embodiment from that of the second embodiment is such that both the first detecting apparatus 117 and the second detecting apparatus 118 are arranged in the vicinity of the bottom portion of the appliance main body 101. It should be noted that the same reference numerals shown in the second embodiment will be employed as those for denoting the same structural elements, and therefore explanations thereof are omitted.

First, gas generated while another heat-cooking apparatus installed under the appliance main body 101 is used is detected by the first detecting apparatus 117 which is arranged in the vicinity of the bottom portion of the appliance main body 101 to actuate the ventilation fan 110. Both the first detecting apparatus 117 and the second detecting apparatus 118 are located close to the generation source of this generated gas, the detection of this generated gas can be quickly carried out. Even in such a case that a food product is heated by the high frequency heat-cooking apparatus equipped with the oven hood, since both the first detecting apparatus 117 and the second detecting apparatus 118 are separated from the heating chamber 105 at high temperatures and the high frequency generating apparatus 106 at high temperatures, adverse influences caused by the heat produced from these heating chamber 105 and high frequency generating apparatus 106 can be reduced.

As previously explained, in accordance with this third embodiment, since both the first detecting apparatus 117 and the second detecting apparatus 118 are arranged in the vicinity of the bottom portion of the appliance main body 101, the gas generated while another heat-cooking apparatus 103 installed under the appliance main body 101 is used can be quickly detected. Also, even in the case that the food product is heated by the high frequency heat-cooking apparatus equipped with the oven hood, the erroneous detecting operations of the first detecting apparatus 117 and the second detecting apparatus 118, which are caused by the heating chamber 105 at the high temperatures and the high frequency generating apparatus at the high temperatures, can be reduced.

(Embodiment 4)

Figure 9:
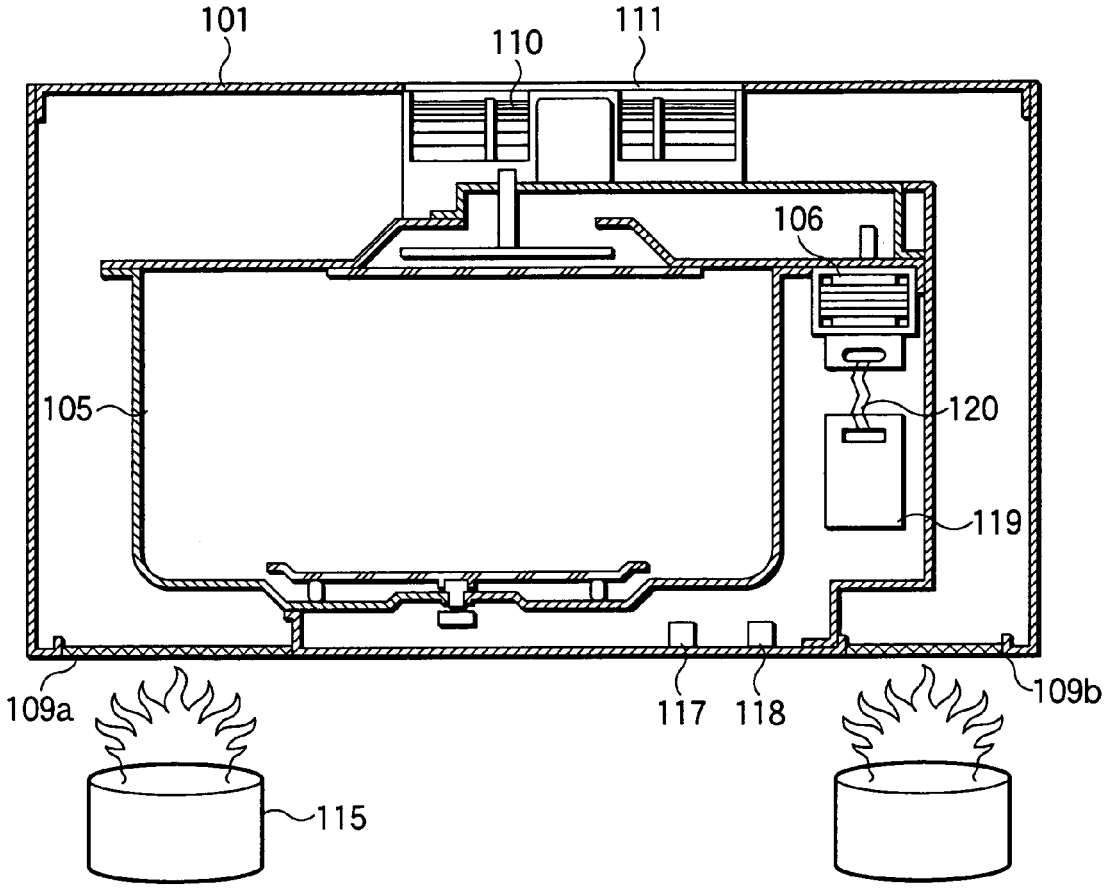
FIG. 9 is a sectional view for indicating a major portion of a high frequency heat-cooking apparatus equipped with an oven hood, according to an embodiment 4 of the present invention.

FIG. 9 is a sectional view for representing a major portion of a high frequency heat-cooking apparatus equipped with an oven hood, according to a forth embodiment of the present invention. In FIG. 9, a second detecting apparatus 118 is arranged in the vicinity of an air intake portion 110, as compared with a first detecting apparatus 117. A different arrangement of this forth embodiment is such that the second detecting apparatus 118 is arranged in the vicinity of the air intake port 110, as compared with the first detecting apparatus 117. It should be noted that the same reference numerals shown in the third embodiment will be employed as those for denoting the same structural elements, and therefore explanations thereof are omitted.

First, since the second detecting apparatus 118 is arranged in the vicinity of the air intake portion 110, as compared with the first detecting apparatus 117, the ventilation fan 110 is actuated. In the case that generated gas passes through an air exhaust path of the appliance main body 101, both the generated gas and firing of a food product can be easily detected. The second detecting apparatus 118 can quickly detect both the generated gas and the fired food product to interrupt supplies of electric power to the high frequency generating apparatus 106, the control means 119, and the electric circuit 120, so that suction of flames and blowing of flames can be quickly stopped.

As previously explained, in accordance with this forth embodiment, since the second detecting apparatus 118 is arranged in the vicinity of the air intake portion 110, as compared with the first detecting apparatus 117, both the generated gas and firing of a food product can be easily detected by the second detecting apparatus 118 to interrupt supplies of electric power to the high frequency generating apparatus 119, and the electric circuit 120, so that suction of flames and blowing of flames can be quickly stopped.

(Embodiment 5)

Figure 10:
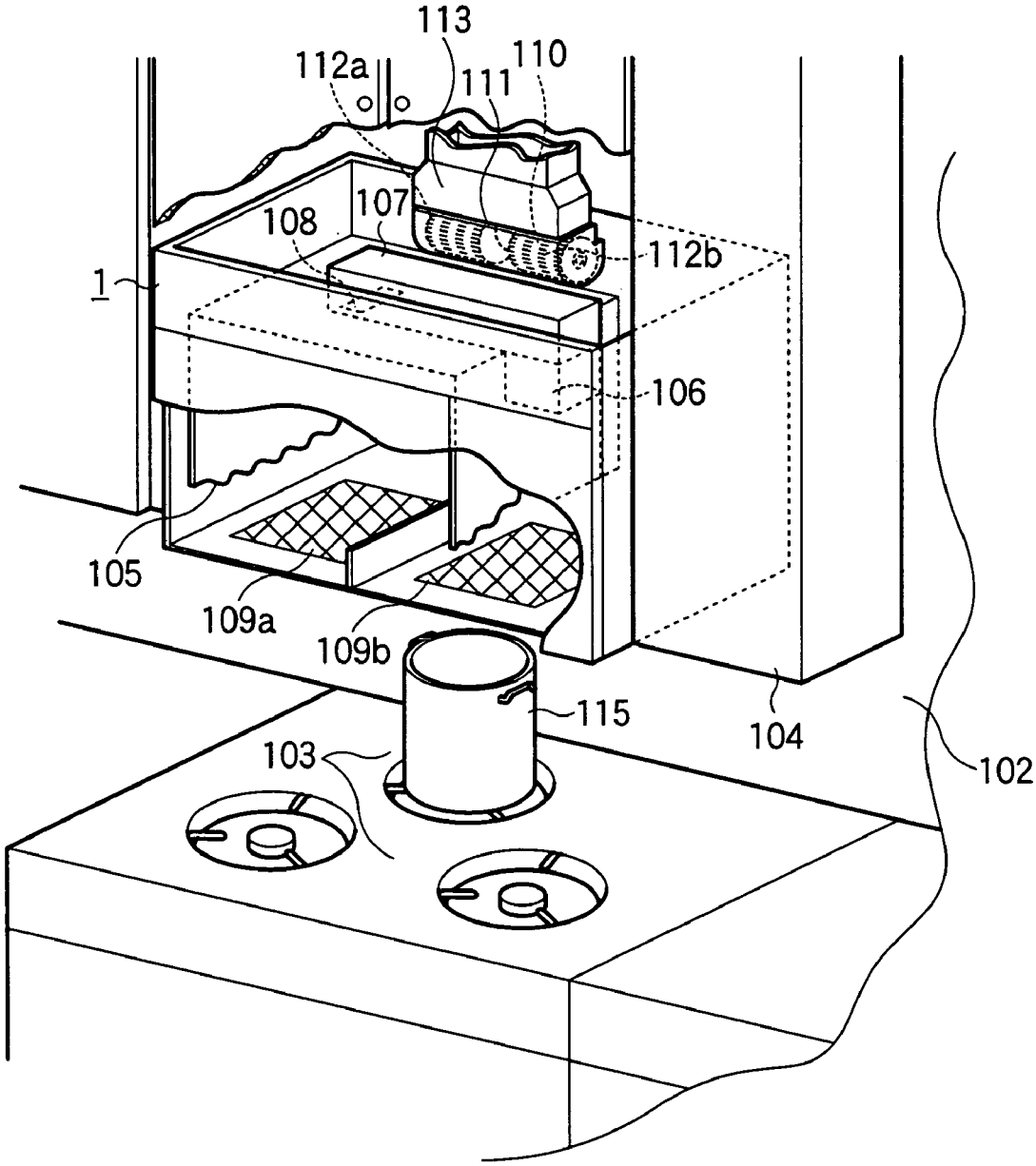
FIG. 10 is a perspective view for indicating the outer view of the conventional high frequency heat-cooking apparatus equipped with the oven hood.

FIG. 10 is a sectional view for representing a major portion of a high frequency heat-cooking apparatus equipped with an oven hood, according to a fifth embodiment of the present invention. In FIG. 8, a detection sensitivity of a second detecting apparatus 118 is set to be lower than a detection sensitivity of a first detecting apparatus 117. A different arrangement of this fifth embodiment from that of the third embodiment is such that the detection sensitivity of the second detecting apparatus 118 is set to be lower than that of the first detecting apparatus. It should be noted that the same reference numerals shown in the third embodiment will be employed as those for denoting the same structural elements, and therefore explanations thereof are omitted.

First, since the detection sensitivity of the second detecting apparatus 128 is set to be lower than that of the first detecting apparatus 117, in such a case that a food product and generated gas do not fire while another heat-cooking apparatus installed under the appliance main body 101 is used, the ventilation fan 110 may constitute the normal automatic ventilating apparatus, by which an erroneous operation can be eliminated. That is, in this erroneous operation, the high frequency heat-cooking apparatus equipped with the oven hood is carelessly stopped. In this case, in the case that both the first detecting apparatus 117 and the second detecting apparatus 118 are constituted by a temperature sensor for sensing a temperature, or a thermistor, since a sensing temperature of the second detecting apparatus 118 is set to be higher than a sensing temperature of the first detecting apparatus 117, the second detecting apparatus 18 may react only high temperatures such as flames. As a result, this effect can be achieved.

As previously described, in accordance with this fifth embodiment, since the detection sensitivity of the second detecting apparatus 118 is set to be lower than the detection sensitivity of the first detecting apparatus 117, the ventilation fan 110 may be actuated by the function of the first detecting apparatus 117 during the normal use condition, so that this ventilation fan 110 may function as the automatic ventilating apparatus. Thus, such an erroneous operation can be prevented in which the high frequency heat-cooking apparatus equipped with the oven hood is carelessly stopped by detecting such generated gas which has not yet fire by using the second detecting apparatus 118.

(Embodiment 6)

Figure 11:
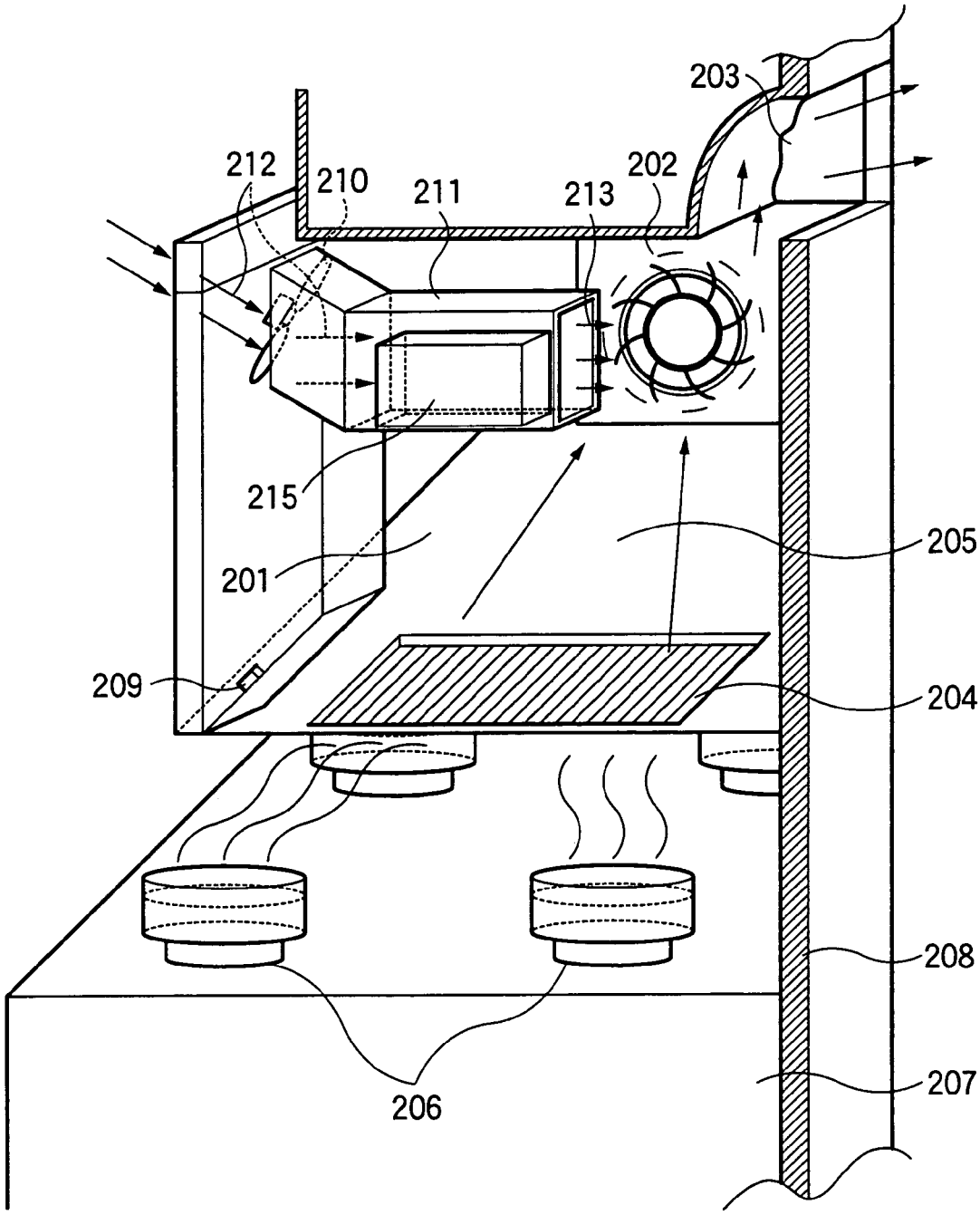
FIG. 11 is a diagram for explaining a cooling structure of a high frequency heating apparatus according to an embodiment 6 of the present invention.

FIG. 11 represents a cooling structural diagram of a high frequency heating apparatus according to a sixth embodiment of the present invention.

In FIG. 11, reference numeral 201 indicates a heating chamber, reference numeral 202 shows an oven hood fan, reference numeral 203 indicates an air exhaust port of the oven hood fan, reference number 204 shows an air intake port of the oven hood fan, and reference numeral 205 indicates heat vapor produced from a lower-installed heat-cooking apparatus. Also, reference numeral 206 shows a lower-set heat-cooking article, reference numeral 207 indicates a lower-installed heat-cooking apparatus, reference numeral 208 denotes a wall plane of a housing, reference numeral 209 represents a means for sensing heat generated from the lower-set heat-cooking article 206, and reference numeral 210 shows a cooling means for cooling an electric power supplying apparatus. Also, reference numeral 211 shows a cooling wind path which is covered with a rigid member, reference numeral 212 indicates air-intake cooling wind, reference numeral 213 represents air-exhaust cooling wind, and further reference numeral 215 shows an electric power supplying apparatus.

A description will now be made of operations and effects as to the high frequency heating apparatus constructed in the above-described manner.

First, in FIG. 11, when the article to be heated starts to be heated by the high frequency heating apparatus, temperatures of components (electronic parts) of the electric power supplying apparatus 215 are gradually increased due to self-heat generations. However, normally, sufficient cooling effects can be achieved by the cooling means 210. In particular, when the lower-installed heat-cooking apparatus is operated by way of gas or electric power, while high output power thereof is recently wanted by customer's needs, since a very large amount of heat is produced, ambient temperatures are increased, and also, the temperature of the cooling wind 212 of the electric power supplying apparatus 215 is similarly increased. In connection with this temperature increase, cooling capabilities of the electric power supplying apparatus 215 are deteriorated, so that this electric power supplying apparatus may be sometimes destroyed due to an overheat phenomenon. In this embodiment of the present invention, when the lower-installed heat-cooking apparatus 207 driven by such as gas and electric power is operated as showing FIG. 11, a temperature change of heat vapor 205 generated from this heat-cooking article 206 is sensed by the temperature sensing means 209 which is mounted at a place where this temperature sensing means 209 can easily sense this temperature change so as to automatically operate the oven hood fan 202. As a consequence, even under such a high-temperature atmospheric condition that the cooling capability of the electric power supplying apparatus 215 is lowered, the electric power supplying apparatus 215 can be protected from the overheat destruction (overheat breakdown) by employing the arrangement which is not changed form the arrangement during the normal use.

Figure 12A:
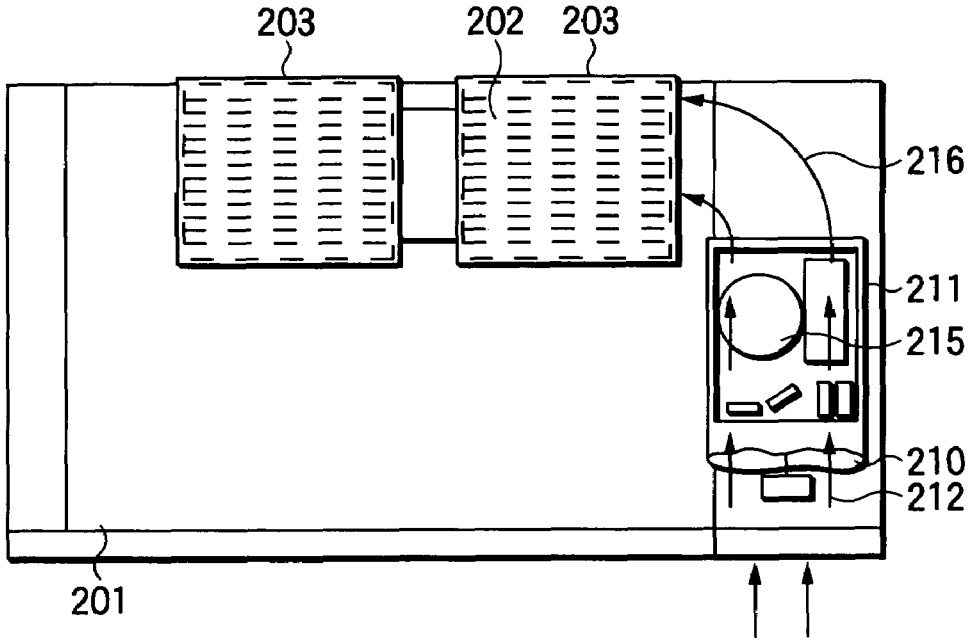
FIGS. 12A and 12B is explanatory diagrams for explaining a difference between cooling wind paths when the oven hood fan is operated (FIG. 12B), and is not operated (FIG. 12A) in the embodiment 6 of the present invention.
Figure 12B:
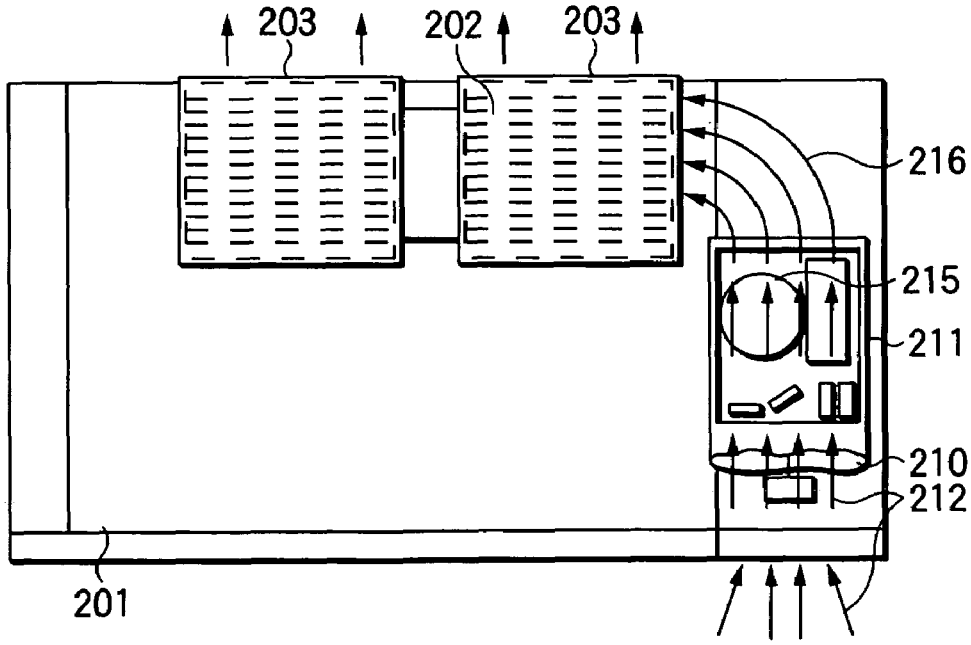

FIGS. 12A and 12B are explanatory diagrams for explaining a difference between wind amounts and cooling wind paths when the oven hood fan 202 of the high frequency heating apparatus, according to the sixth embodiment of the present invention, is not operated, and is operated.

In FIGS. 12A and 12B, reference numeral 216 shows strong air-intake wind which is produced when the oven hood fan is operated, in addition to the structural elements 201 to 215 represented in FIG. 11.

Operations and effects as to the high frequency heating apparatus with employment of the above-explained construction will now be explained.

In FIGS. 12A and 12B, since the lower-installed heat-cooking apparatus 207 shown in FIG. 11 is operated, the oven hood fan 202 is automatically operated by the temperature sensing means 209 which senses heat vapor 205 generated from the heat-cooking article 206. The strong air-intake capability 216 of this oven hood fan 202 may suck exhaust air of the cooling path 211, so that the cooling capability of the electric power supplying apparatus located within the cooling path 211 may be largely increased. It should be understood that since the electric power supplying apparatus 215 covered by the rigid member and the air exhausts port of the cooling path 211 thereof are arranged in such a manner that both the electric power supplying apparatus 215 and the air exhaust port thereof are located in the vicinity of the air suction port of the oven hood fan 202, the cooling efficiency of the electric power supplying apparatus can be furthermore increased.

Figure 13:
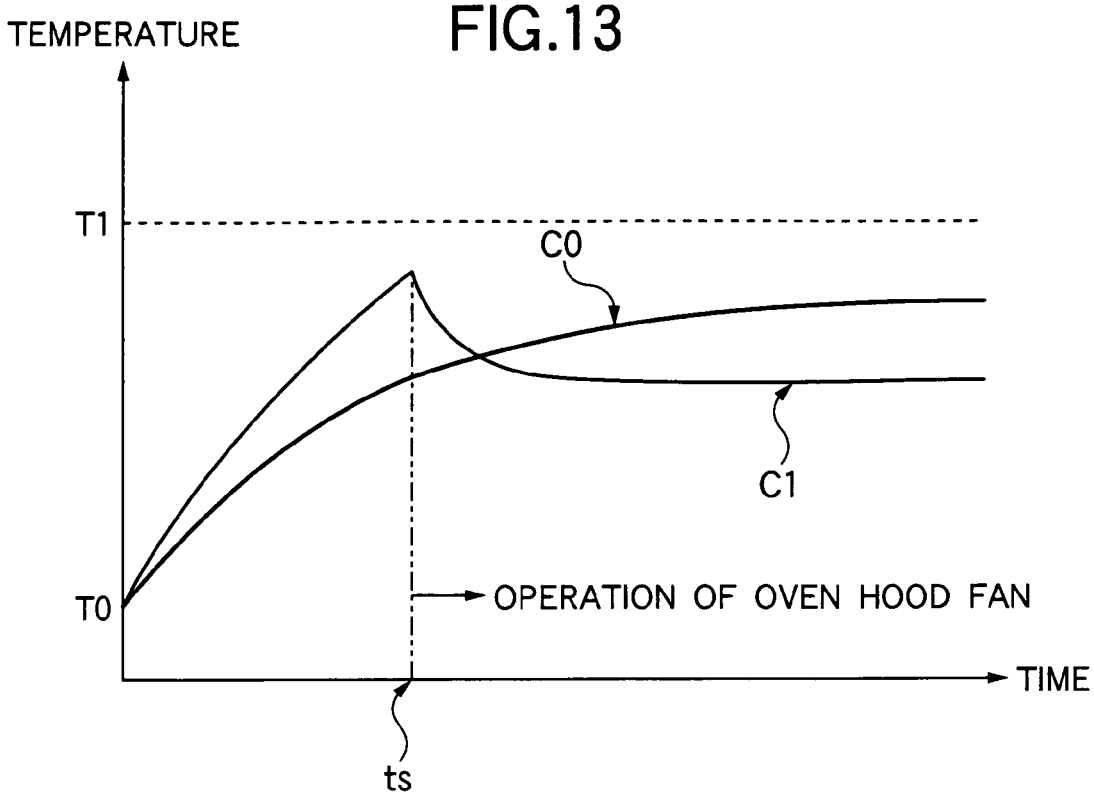
FIG. 13 is an explanatory diagram for explaining a difference between cooling effects achieved when the oven hood fan is operated, and is not operated in the embodiment 6 of the present invention.

FIG. 13 is an explanatory diagram for explaining cooling effects caused by a difference between cooling wind paths when the oven hood fan 202 of the high frequency heating apparatus, according to the sixth embodiment of the present invention, is not operated, and is operated, as shown in FIG. 11, FIG. 12A, and FIG. 12B.

In FIG. 13, T0 indicates a room temperature, T1 indicates a thermal destruction temperature of electric power supplying apparatus, ts indicates a time when automatic operation of oven hood fan is commenced, a line C0 represents a temperature characteristic of heating element of electric power supplying apparatus when lower-installed heat-cooking apparatus is not operated, and a line C1 represents temperature characteristic of heating element of electric power supplying apparatus when lower-installed heat-cooking apparatus is operated.

Operations and effects as to the high frequency heating apparatus with employment of the above-explained construction will now be explained.

FIG. 13 graphically indicates such a difference between heating member cooling effects of the electric power supplying apparatus 215 when the lower-installed heat-cooking apparatus 207 is operated, and is not operated. When the lower-installed heat-cooking apparatus 207 is not operated, the electric power supplying apparatus 215 is designed in such a manner that this electric power supplying apparatus 215 does not exceed the thermal destruction (break down) temperature. Therefore, there is no problem. On the other hand, when the lower-installed heat-cooking apparatus 207 is operated, the electric power supplying apparatus 215 receives a thermal adverse influence caused by heat vapor 205 generated from the heat-cooking article 206, so that the temperature of the air suction cooling wind 212 is increased and is continuously increased in such a way that this increased temperature of the air suction cooling wind 212 will exceed the thermal destruction temperature of the electric power supplying apparatus 215. However, the cooling capability may be increased in such a manner that the oven hood fan 202 is automatically operated by using the temperature sensing means 209 when the increased air suction cooling wind 212 reaches a preset temperature, but does not exceed the thermal destruction temperature. As a result, the temperature increase of the electric power supplying apparatus 215 can be largely suppressed. As to the temperature setting operation of the temperature sensing means 209, while the temperature sensing means 209 is provided at such a place where this temperature sensing means 209 can easily sense heat from the lower-installed heat-cooking apparatus 207, the sensing temperature of this temperature sensing means 209 can be easily set by establishing a correlative relationship with respect to the thermal destruction temperature of the electric power supplying apparatus 215. Also, in such a case that the oven hood fan 202 is wanted to be actuated at an earlier stage in order to accept needs of a customer, this temperature setting value is lowered. As a result, the temperature curve of the heating member of the electric power supplying apparatus 215 shown in FIG. 13 shows a temperature which is furthermore lower than the presently-indicated temperature, and therefore, the safety characteristic of the product can be furthermore increased.

Figure 14:
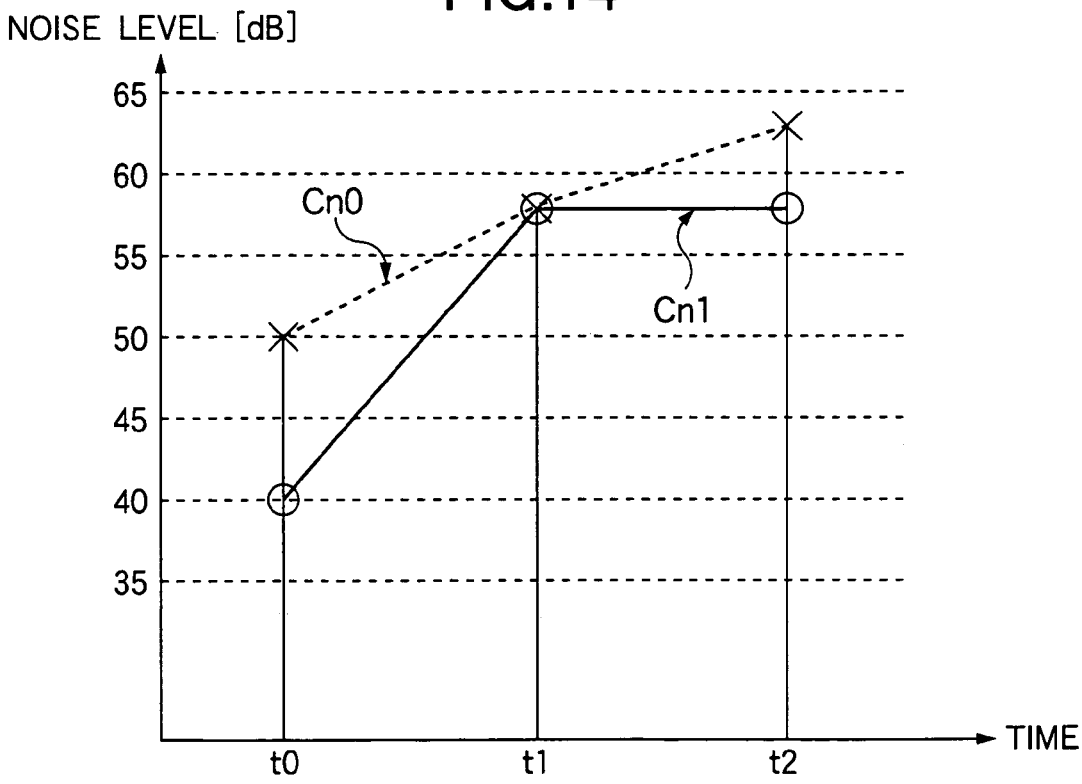
FIG. 14 is a diagram for graphically showing a silencing effect achieved in the embodiment 6 of the present invention.

FIG. 14 is a diagram for graphically representing a silencing effect of cooling apparatus with a simple structure according to the sixth embodiment shown in FIG. 11, FIG. 12A, and FIG. 12B.

In FIG. 14, a line Cn0 represents a noise characteristic of conventional cooling apparatus structure, a line Cn1 represents a noise characteristic of structure equipped with cooling apparatus of the present invention, t0 indicates a time when only high frequency heating operation is actuated and atmospheric temperature is low, t1 indicates a time when only oven hood fan is operated, and t2 indicates a time when both high frequency heating apparatus and oven hood fan are operated and atmospheric temperature is high.

As to a high frequency heating apparatus with employment of the above-described arrangement, operations and effects thereof will now be explained.

Since the high frequency heating apparatus equipped with the cooling apparatus, according to the present invention, owns the simple instruction capable of suppressing the cooling capability of the cooling apparatus to a minimum required cooling capability, a noise level produced when the high frequency heat-cooking operation is carried out can be suppressed to a very low noise level, as compared with that of the conventional structure. Also, when the ambient temperature is increased under which the cooling efficiency is lowered, the oven hood fan is automatically operated. As a result, the required cooling capability can be supplemented by employing the simple structure, according to the present invention. Also, the noise level of the cooling apparatus can be largely reduced in a similar level when the high frequency heating apparatus is solely operated, as compared with the conventional high frequency heating apparatus having the powerful cooling apparatus.

Figure 15:
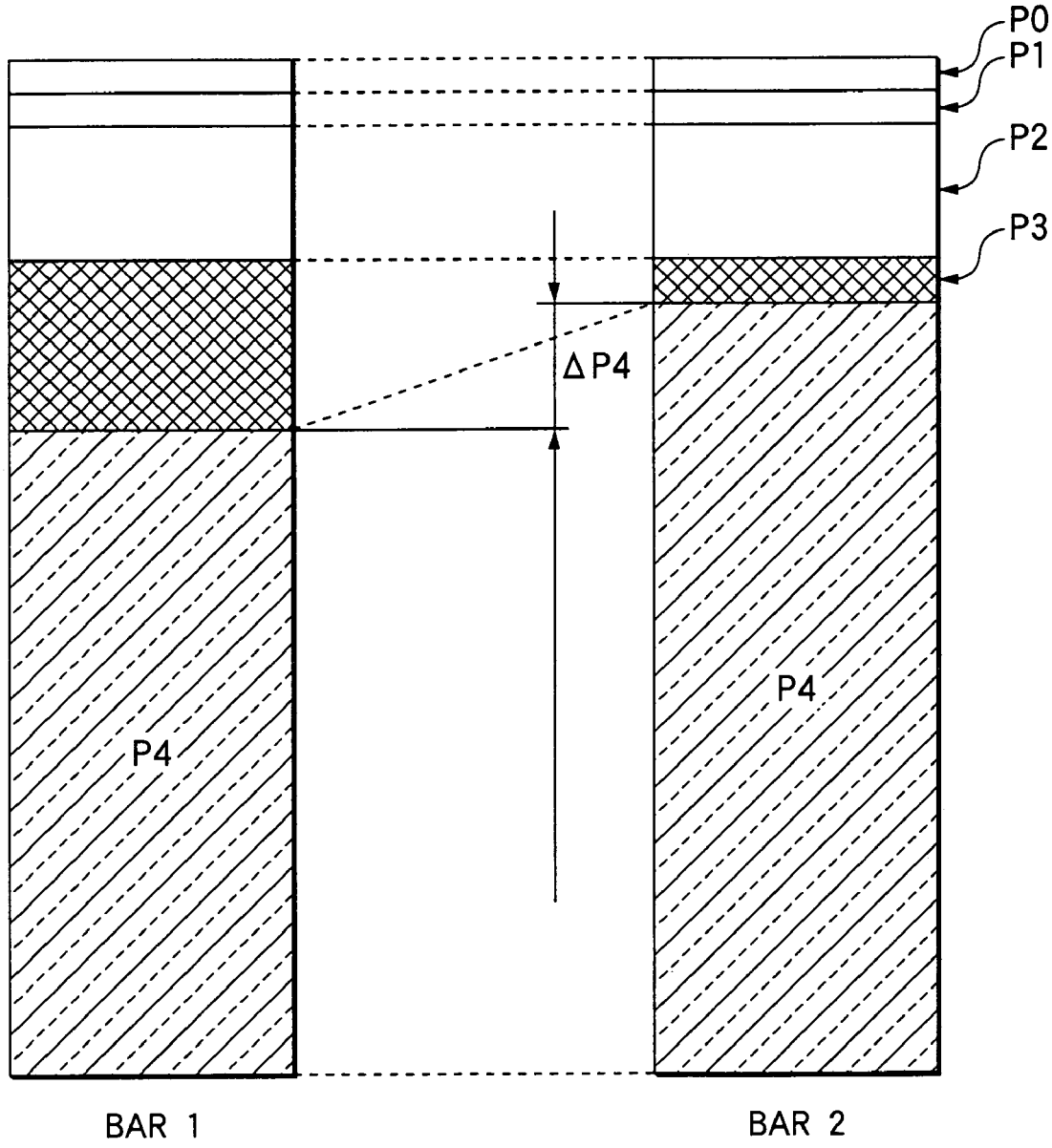
FIG. 15 is a diagram for indicating a power save structure of an automatic cooking discriminating apparatus according to an embodiment 6 of the present invention.

FIG. 15 is a diagram for indicating a power-saving structure of the cooling apparatus having the simple structure, according to the sixth embodiment shown in FIG. 11, FIG. 12A, and FIG. 12B.

In FIG. 15, BAR 1 represents a power construction occupied by respective electric components in prior art, BAR 2 represents a power construction occupied by respective electric components in present invention. In the bars, P0 indicates power of illumination lamp, P1 indicates power of heating-article rotation means, P2 indicates power of oven hood fan, P3 indicates power of cooling apparatus, and P4 indicates power for high frequency heating. Furthermore, ΔP4 indicates increased high frequency output power by simplifying cooling apparatus.

A description is made of operations and effects as to the high frequency heating apparatus with employment of the above-described arrangement.

In accordance with the high frequency heating apparatus equipped with the cooling apparatus according to the present invention, the cooling apparatus does not consume very high power with respect to a total electric power value, the upper limit value of which is limited as the product, although the conventional cooling apparatus consumes high electric power. As a result, the saved electric power can be used in the high frequency heating operation, so that this high frequency heating apparatus can realize high-speed cooking by using the high power.

As previously explained, in this sixth embodiment, the electric power supplying apparatus of the high frequency heating apparatus is provided in the cooling path which is covered by the rigid member, and under such a thermal server environment when the lower-installed heat-cooking apparatus is operated, this sever temperature is sensed to automatically operate the oven hood fan. As a result, the cooling capability of the electric power supplying apparatus can be supplemented in response to the ambient environment, the destruction of the components caused by the overheat phenomenon occurred when the ambient environmental temperature is increased can be avoided, and the silencing effects at the cooking place can be realized. Since the cooling capability of the electric power supplying apparatus operated under normal condition is suppressed, the high power of the high frequency heating power can also be realized.

As previously explained, since the magnetron is cooled by using a portion of the cooling wind of the ventilation fan, the machine chamber of the main body can be made compact, and also, the magnetron cooling fan is no longer required, so that the high frequency heating apparatus can be made in low cost.

Since both the ventilation fan and the magnetron are arranged over the heating chamber, the wave-guide can be made short and the high frequency loss can be reduced, so that the efficiency of the appliance can be increased.

Since the fan cases of the ventilation fans are separated to both the fan case for exhausting the hot air of the cooker and the fan case for cooling the magnetron. As a result, even when the exhausting direction of the hot air from the cooker is changed along various directions, for instance, the forward direction, the upper direction, and the backward direction, the magnetron can be continuously cooled.

As previously described, the gas generated from another heat-cooking apparatus which is being used and is installed under the high frequency heat-cooking apparatus equipped with the oven hood can be automatically ventilated. Furthermore, even when the food product under cooking fires while another heat-cooking apparatus installed under the high frequency heat-cooking apparatus equipped with the oven hood is used, the supply of the electric power to the appliance main body can be automatically interrupted by the second detecting apparatus.

As previously explained, although the cooling condition of the high frequency heating apparatus equipped with the oven hood function is deteriorated when the lower-installed heat-cooking apparatus is operated and is very recently manufactured in high output power, the overheat destruction of the electric power supplying apparatus even when the lower-installed heat-cooking apparatus is operated can be prevented by merely employing such a simple structure that this high frequency heating apparatus is provided with the cooling capability sufficient for that of the normal use operation (namely, when lower-installed heat-cooking apparatus is not operated). At the same time, while the cooling apparatus of the high frequency heat-cooking apparatus can be operated under silent condition and the high-frequency high power can be outputted, this high frequency-heating apparatus can be operated in a higher electric efficiency and also under safety and silent performance. Furthermore, in order to stabilize the automatic cooking discrimination functions, the wind-blowing fan is separately provided with respect to the cooling operation of the electric power supplying apparatus, so that the cooking information derived from the article to be heated can be fed to the automatic cooking sensing apparatus without adverse influences caused by the oven hood fan operation. Therefore, the automatic cooking information sensing operation can be realized in the stable manner even under any conditions.

What is claimed is:

1. A high frequency heating apparatus comprising:

a heating chamber for placing or removing an object to be heated into or from the heating chamber;

an electric power supplying apparatus for radiating electromagnetic waves into the heating chamber further including a heating element;

a cooling means generating a cooling wind for cooling the electric power supplying apparatus;

another heat-cooking apparatus installed under the high frequency heating apparatus;

a ventilating means for sucking and exhausting hot air generated from from the another heat-cooking apparatus through an air intake port, wherein the air intake port is installed under the high frequency cooking apparatus; and, a temperature sensing means to sense heat generated from the another heat-cooking apparatus and the cooling wind to automatically actuate the ventilating means from the heat generated by either the another heat-cooking apparatus or the cooling wind;

wherein the cooling wind from the cooling means is joined onto an air intake path of the ventilating means.

2. The high frequency heating apparatus according to claim 1, wherein the ventilating means is an oven hood fan.

3. The high frequency heating apparatus according to claim 2, wherein the electric power supplying apparatus and the ventilating means are arranged over the heating chamber.

4. The high frequency heating apparatus according to claim 3, wherein the heating element of the electric power supplying apparatus is covered along a cooling wind path.

5. The high frequency heating apparatus according to claim 3, wherein the cooling means is mounted in an integral manner on such a structure that the heating element of the electric power supplying apparatus is covered along a cooling wind path.

* * * * *

UNITED STATES PATENT AND TRADEMARK OFFICE

CERTIFICATE OF CORRECTION

PATENT NO. : 6,974,936 B2
DATED : December 13, 2005
INVENTOR(S) : Yamauchi et al.

It is certified that error appears in the above-identified patent and that said Letters Patent is hereby corrected as shown below:

Title page,
Item [57], ABSTRACT,
Line 9, delete "means" and insert -- fan --.

Column 4,
Line 30, after "exhaust" insert -- resistance --.

Column 16,
Line 59, delete the second occurrence of "from".

Signed and Sealed this

Sixth Day of June, 2006

JON W. DUDAS
*Director of the United States Patent and Trademark Office*